United States Patent [19]

Castagna

[11] 4,427,244

[45] Jan. 24, 1984

[54] SLIDING WALL-UNIT FURNITURE ASSEMBLY

[76] Inventor: Erna Castagna, Knödelhüttenstr. 35, 1140 Wien, Austria

[21] Appl. No.: 240,243

[22] Filed: Mar. 3, 1981

[30] Foreign Application Priority Data

Mar. 7, 1980 [AT] Austria ..... 1271/80

[51] Int. Cl.[3] ..... A47B 67/02; E05D 15/58

[52] U.S. Cl. ..... 312/245; 312/198; 312/246; 49/257; 49/411; 16/104

[58] Field of Search ..... 312/245, 246, 247, 248, 312/249, 116, 238, 198; 248/323; 16/87, 104; 49/409, 411, 257; 5/2 R, 2 B

[56] References Cited

U.S. PATENT DOCUMENTS

| | | | |
|---|---|---|---|
| 1,188,482 | 6/1916 | Phillips | 49/257 |
| 1,680,133 | 8/1928 | Crawford | 16/104 |
| 2,499,240 | 2/1950 | Aiken | 312/246 |
| 2,503,848 | 4/1950 | Smith, Jr. | 16/104 |
| 2,643,167 | 6/1953 | Wade | 312/246 |
| 3,063,496 | 11/1962 | Kessler | 49/257 |
| 3,063,768 | 11/1962 | Moore, Jr. | 312/198 |
| 3,843,995 | 10/1974 | Merrill | 49/409 |
| 3,953,093 | 4/1976 | Hero | 312/245 |
| 3,990,183 | 11/1976 | Meggs et al. | 49/411 |
| 4,141,106 | 2/1979 | Dixon | 16/104 |
| 4,180,298 | 12/1979 | Borgerson, Jr. | 312/246 |
| 4,302,865 | 12/1981 | Dixon et al. | 16/104 |

FOREIGN PATENT DOCUMENTS 2458141 6/1976 Fed. Rep. of Germany .

*Primary Examiner*—Victor N. Sakran

*Attorney, Agent, or Firm*—Karl F. Ross; Herbert Dubno

[57] ABSTRACT

A wall-unit furniture assembly comprises a stationary wall unit comprising a grouping along each of a pair of perpendicular walls. A front rail and a rear rail are supported parallel to each other on the upper edge of these groupings and run via arcuate corner sections around the corner between the two groupings. A rear sliding door is suspended on the rear rail by means of a roller trolley and a front sliding cabinet is suspended on the front rail by means of further such roller trolleys. These trolleys are provided at the extreme rear side corners of the door and cabinet so that they can move around the corner, and the door can slide behind and past the cabinet.

4 Claims, 3 Drawing Figures

FIG.1
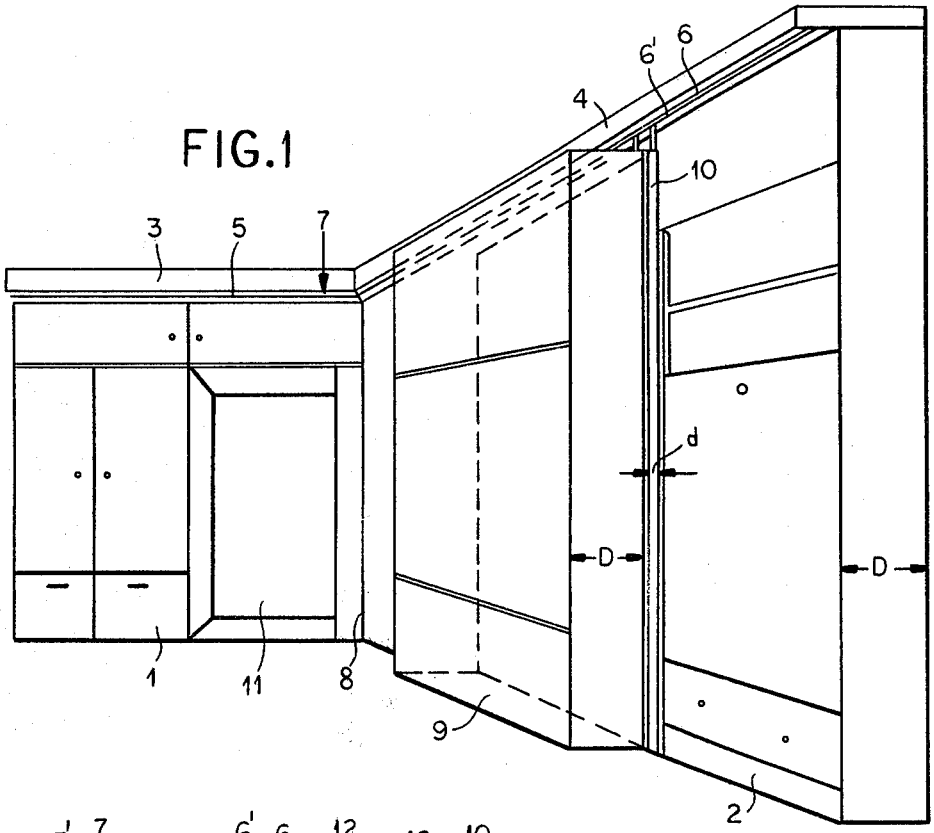
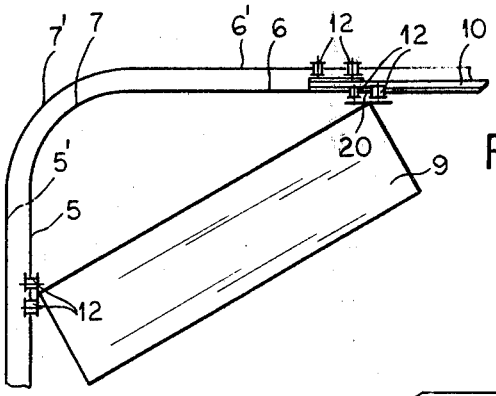
FIG.2
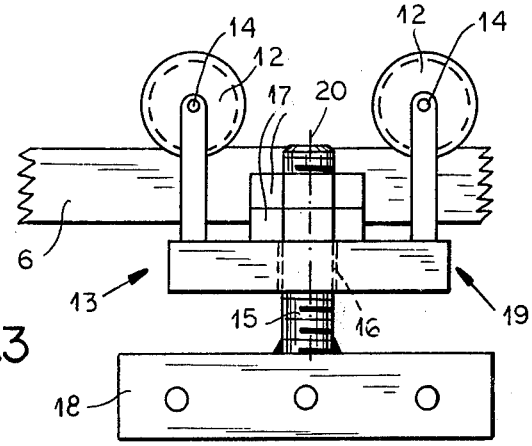
FIG.3

SLIDING WALL-UNIT FURNITURE ASSEMBLY

FIELD OF THE INVENTION

The present invention relates to a wall-unit assembly. More particularly this invention concerns such an assembly having slidable parts.

BACKGROUND OF THE INVENTION

A wall-unit assembly is known which stands against the wall and comprises a plurality of separate units, such as a closet, a desk, and a drop-down or Murphy bed. It is known to provide such an arrangement with a sliding cabinet that itself has considerable storage space and that can be moved into position in front of any of the other units or even in front of the bed when it is tipped up so as to hide it. Furthermore it is standard practice to provide such a unit with a horizontally sliding door which can also be used to cover the bed or opening when the bed is tipped up.

Normally the stationary wall unit is provided at its upper edge with a rail from which the sliding cabinet and door are suspended. Roller hardware is provided for hanging the cabinet and door from this rail so that same can be moved relatively easily along the wall unit.

The disadvantage of these systems is that, for example, when the bed is down the door and cabinet must be slid to the side where they block access to the wall unit. Only after pushing the bed back up can the door or cabinet be moved back in front of the raised bed to give access to the stationary wall unit. In addition the sliding cabinet and the sliding door cannot move past each other on the rail, so that they always leave at least two rear units blocked.

OBJECTS OF THE INVENTION

It is therefore an object of the present invention to provide an improved wall-unit furniture assembly.

Another object is to provided such an assembly which makes it possible to gain access to virtually any of the parts of the stationary wall unit at any time.

SUMMARY OF THE INVENTION

These objects are attained in accordance with the instant invention in a wall-unit furniture assembly wherein the stationary wall unit carries at its upper edge a front rail and a rear rail which are supported parallel to each other. Front and rear hardware mount a rear sliding door and a front sliding cabinet on the front and rear rails for displacement threrealong independent of each other. According to this invention the rear door can slide between the front cabinet and the wall unit.

Thus with the system according to the instant invention it is possible to slide the rear door behind the cabinet, or past the cabinet to the other side of it, since these two elements are movable completely independently of each other.

According to further features of this invention each of the front and rear rails includes a pair of straight rail sections extending at an angle to each other and an arcuate corner section interconnecting the respective straight sections. The hardware includes front and rear rollers respectively carried on the front cabinet and rear door and engaging the front and rear rails. These rollers are provided at the outer upright edges of the cabinet and the door so that the cabinet and door can move around the corner between the straight rail sections. Thus when, as is standard, the stationary wall unit extends along two perpendicular walls of a room, it is possible for the sliding cabinet and door to move from along one wall to along the adjacent wall, a feature not hitherto possible with this type of wall-unit furniture assembly.

This is possible according to the instant invention by mounting the sliding door and cabinet each by means of a pair of trolleys on the respective rail. Each of these trolleys has a pair of grooved wheels riding on the respective rail, a support carrying these two wheels for rotation about respective horizontal axes spaced apart along the rail, and an upright spindle extending down to a support plate on the sliding door or cabinet. The carrier for the roller is pivotal about the veritcal axis of this spindle so that both rollers can remain firmly on the respective track while the door or cabinet underneath it pivots about the vertical axis as it moves from a position flat against one wall to a position flat against the other wall. The versatility such an arrangement adds to the system is considerable, making it possible to move about the slidable portions of the wall-unit system to obtain virtually any desired combination.

DESCRIPTION OF THE DRAWING

FIG. 1 is a perspective view of the furniture assembly according to this invention;

FIG. 2 is a top partly schematic view of a portion of the system of FIG. 1; and FIG. 3 is a side view of a detail of the system according to this invention.

SPECIFIC DESCRIPTION

As seen in FIG. 1 is a grouping 1 of wall-unit furniture is provided along one wall of a room and another grouping 2 is provided along the adjacent wall which runs at 90° to the wall of the grouping 1. Each of these groupings 1 and 2 includes a plurality of various cupboards, closets, bookshelves, drawers, and the like as is well known in the art. The various units are modular and of a standard depth D measured in a direction perpendicular to the wall they normally lie against. It is possible for these units to incorporate a so-called Murphy bed which can be folded up into the unit when not in use. The grouping 1 fits around a rectangular doorway 11 near the corner of the room.

The grouping 1 is provided at its upper level with an upper-edge valance 3 and the grouping 2 with another such valance 4. Provided inside these valances 3 and 4 are front and rear rails. The front rail includes a straight section 5 along the grouping 1, another straight section 6 along the grouping 2, and an arcuate section 7 joining the sections 5 and 6. Similarly the rear section includes two straight sections 5' and 6' along the groupings 1 and 2 and an arcuate section 7' interconnecting them. These rails run parallel to each other with the rear rail 5', 6', 7' lying behind the front rail 5, 6, 7. Thus the rails run continuously past the inside corner 8 of the room.

According to this invention a sliding cabinet 9 of a depth D equal to that of the groupings 1 and 2 is hung from the front rail 5, 6, 7, and a door panel 10 of a depth d is hung from the rear rail 5', 6', 7'. Rollers at the bottom of the cabinet 9 and door 10 ride along the lower regions of the groupings 1 and 2 to keep the cupboard 9 and the door 10 vertical and parallel to the groupings 1 and 2.

As shown in FIG. 3 the cabinet 9 and door 10 are provided with trolleys 19 each having a pair of grooved rollers 12 riding on the respective rail and rotatable about parallel horizontal axes 14 defined by a yoke-type roller support 13. This roller support 13 is formed with a throughgoing unthreaded hole 16 through which extends a threaded spindle 15 welded at its lower end to a plate or cleat 18 that is screwed to the back of the respective cabinet 9 or door 10 adjacent the vertical side edge thereof. A pair of locking nuts 17 are screwed onto this threaded spindle 15 above the yoke 13.

It is therefore apparent, as shown in FIG. 2, that each of the trolleys 19 allows the item hung on it to pivot about an axis 20 defined by the respective spindle 15 and lying substantially at the rear side corner of the suspended element. For this reason it is possible for the cupboard 9 and door 10 to move around the corner 8. In addition minor discrepancies in height can be compensated for by screwing the nuts 17 in one direction or another along the spindle 15.

With the system of the instant invention it is therefore possible for a cabinet 9 or door 10 whose lower edge lies substantially at the lower edge of the groupings 1 and 2 to move independently of one another along these groupings 1 and 2 and even around the corner 8 between them. Since the trolloeys 19 are mounted at the extreme rear side corners of the elements they are suspended from, traveling around the corner is possible. What is more it is possible for the door 10 to be slid behind the cabinet 9 to get it out of the way, or to even be slid behind and past the cabinet 9 without touching it.

I claim:

1. A wall-unit furniture assembly comprising:

a stationary wall unit having an upper edge and two portions extending at an angle to each other;

a front rail and a rear rail supported parallel to each other on said upper edge and each including a pair of straight rail sections extending at an angle to each other along the respective wall-unit portions and an arcuate corner section interconnecting the respective straight sections;

a rear sliding door having outer upright edges;

a front sliding cabinet having outer upright edges; and means including front and rear hardware respectively pivotal about respective vertical axes on and hanging said front cabinet and rear door on said front and rear rails for displacement therealong independently of each other, said hardware including front and rear rollers respectively carried on said front cabinet and rear door at the respective edges and engaging said front and rear rails and supports carrying the respective rollers and pivotal on said door and cabinet at said edges about said vertical axes, said supports each carrying two such rollers spaced apart along the respective rail and flanking the respective vertical axis, said rear door being slidable between said front cabinet and said wall unit and wholly past said front cabinet, said supports each including a mounting plate secured adjacent the respective edge, an upright threaded spindle projecting upward from said plate and defining the respective axis, a dolly carrying the respective rollers and formed with a vertically throughgoing hole through which said threaded spindle passes, and at least one nut screwed onto said spindle and bearing downward on said dolly.

2. The assembly defined in claim 1 wherein said door and cabinet have lower edges at substantially the same level.

3. The assembly defined in claim 1 wherein said door is a generally flat planar panel having a thickness measured horizontally perpendicular to said rails and which is considerably smaller than the corresponding dimension of said cabinet.

4. The assembly defined in claim 3 wherein said stationary wall unit has a thickness measured horizontally perpendicular to said rails which is generally equal to the thickness of said cabinet.

* * * * *